US008448367B2

(12) United States Patent
Samson et al.

(10) Patent No.: US 8,448,367 B2
(45) Date of Patent: May 28, 2013

(54) MODULAR FORE-END RAIL/HAND GUARD ASSEMBLY SYSTEM FOR FIREARMS WITH SELECTABLE HEAT DISSIPATION CHARACTERISTICS

(75) Inventors: Scott W. Samson, Whately, MA (US); Jonathan Bernashe, Sunderland, MA (US)

(73) Assignee: Samson Manufacturing Corporation, Whately, MA (US)

( * ) Notice: Subject to any disclaimer, the term of this patent is extended or adjusted under 35 U.S.C. 154(b) by 0 days.

(21) Appl. No.: 13/006,083

(22) Filed: Jan. 13, 2011

(65) Prior Publication Data

US 2012/0180358 A1 Jul. 19, 2012

(51) Int. Cl.
*F41C 23/16* (2006.01)
*F41A 21/48* (2006.01)

(52) U.S. Cl.
CPC ..... *F41A 21/482* (2013.01)
USPC ..... 42/75.02

(58) Field of Classification Search
USPC ..... 42/75.02
See application file for complete search history.

(56) References Cited

U.S. PATENT DOCUMENTS 4,479,418 A * 10/1984 Beretta ..... 89/14.4
4,501,189 A * 2/1985 Brandl et al. ..... 89/14.4
4,512,236 A * 4/1985 Thevis et al. ..... 89/128
4,765,224 A 8/1988 Morris
5,136,924 A * 8/1992 Forster et al. ..... 89/14.4
5,142,806 A 9/1992 Swan
5,343,650 A 9/1994 Swan
5,590,484 A 1/1997 Mooney et al.
6,490,822 B1 12/2002 Swan
6,499,245 B1 12/2002 Swan
6,615,702 B1 9/2003 Julien
RE39,465 E 1/2007 Swan
7,216,451 B1 5/2007 Troy
RE40,216 E 4/2008 Swan
7,458,179 B2 12/2008 Swan
7,464,496 B1 12/2008 Davies et al.
D606,155 S 12/2009 Swan
D606,156 S 12/2009 Swan
D607,958 S 1/2010 Swan
D613,811 S 4/2010 Swan
7,707,762 B1 5/2010 Swan
7,793,452 B1 * 9/2010 Samson et al. ..... 42/72
8,037,633 B1 10/2011 Troy
2006/0260169 A1 11/2006 Samson et al.
2007/0261285 A1 11/2007 Troy
2009/0178325 A1 7/2009 Veilleux
2010/0095575 A1 4/2010 Swan
2010/0236124 A1 9/2010 Troy
2010/0269392 A1 10/2010 Swan
2012/0255213 A1 * 10/2012 Panos ..... 42/115

* cited by examiner

*Primary Examiner* — Michael David
(74) *Attorney, Agent, or Firm* — Burns & Levinson LLP; Bruce D. Jobse, Esq.

(57) ABSTRACT

A modular fore-end rail assembly for mounting onto a firearm includes a hand guard and a bushing element that combines with an end portion of the hand guard to encircle the standard barrel nut, thereby supporting the entire assembly without requiring modification to the standard barrel nut. The thermal transfer characteristics of the material from which the bushing element is manufactured may be selected to either increase or decrease the rate at which heat is transferred from the barrel nut to the hand guard allowing for rapid changes of bushing elements and, therefore, rapid and selective changes in the heating rate of the hand guard.

11 Claims, 7 Drawing Sheets

MODULAR FORE-END RAIL/HAND GUARD ASSEMBLY SYSTEM FOR FIREARMS WITH SELECTABLE HEAT DISSIPATION CHARACTERISTICS

FIELD OF THE INVENTION

The disclosure relates to the field of firearm accessories, and, more specifically, to a modular fore-end rail assembly for retrofitting a firearm which has selectable heat dissipation characteristics and which may be rapidly attached and detached from a firearm.

BACKGROUND OF THE INVENTION

In the general field of combat and commercial weaponry, there is a broad range of accessories available for mounting onto standard firearms in order to upgrade the capability of these weapons. Of particular interest in the context of upgrade accessories is the M16/M4 weapon system that is typically utilized in military or combat settings. Generally, the M16/M4 weapon includes a lower receiver, an upper receiver, a butt stock extending rearwardly from the upper and lower receivers and a barrel that is attached to the front of the upper receiver and extends in a forward direction. The barrel is attached to the front of the upper receiver by inserting the rear end of the barrel into a barrel-receiving receptacle at the front end of the upper receiver. Most new models of the M16/M4 weapons also include a dovetail rail interface integrally formed along the top of the upper receiver. This interface rail provides a convenient mounting point for many of the available accessories for use with the M16/M4 firearm, such as scopes, sighting devices, lasers and directed fire devices. The barrel is held in assembled relation with the upper receiver by a barrel nut that is threaded onto the outside surface of the barrel-receiving receptacle.

Numerous prior arm rail/hand guard assembly systems require permanent modification of the firearm before installation thereof. Specifically, such systems typically require destruction and removal of the original standard barrel nut and replacement with a proprietary barrel configuration. Thereafter, only the proprietary rail/hand guard system which is compatible with the proprietary barrel nut may be used with the firearm. Further, once the original standard barrel not has been removed, the firearm can not be returned to its original standard format. For this reason, systems which require modification or replacement of the standard barrel nut are undesirable.

It is also well known that when a gun is fired rapidly or extensively, the gun barrel increases in temperature, sometimes to several hundred degrees. To protect the user from injury, hand guards are often employed which cover both the barrel and the barrel nut, in addition to providing a surface on which accessories may be attached. Even so, the barrel nut itself, when in direct contact with the hand guard, may also transfer heat from the barrel to the hand guard, causing injury to the user.

It would therefore be useful to provide a modular fore-end rail assembly for use with a firearm that does not require permanent destruction of the barrel nut or other part of the firearm and which allows for the firearm to be rapidly returned to its stock configuration.

It would be further useful to provide a modular fore-end rail assembly for use with a firearm which comprises an element disposed between the barrel nut and the hand guard, in order to affect the rate of heat transfer from the barrel nut to the hand guard.

It would also be useful to provide a variety of rapidly interchangeable elements, each with its own thermal conduction properties, without requiring modification to the standard barrel nut.

BRIEF SUMMARY OF THE INVENTION

Disclosed is a modular fore-end hand guard/rail assembly that is mounted onto a firearm and serves both as a hand guard system and as an integrated interface system for mounting attachments thereto. In particular, the disclosure is directed to an improved mounting configuration for attaching the modular fore-end rail assembly onto the firearm without requiring modification of the barrel nut and which allows for selective reconfiguration to change the thermal exchange characteristics of the rail assembly.

The disclosed modular fore-end rail assembly comprises a hand guard and one or more arcuate bushing element members that combine with an end portion of the hand guard to encircle the standard barrel nut, thereby supporting the entire assembly without requiring modification to the standard barrel nut. The thermal transfer characteristics of the material from which the bushing element members are manufactured may be selected to either increase or decrease the rate at which heat is transferred from the barrel nut to the hand guard. The configuration allows for rapid changes of the bushing element members and, therefore, rapid and selective changes in the heating exchange rate of the guard.

According to one aspect of the invention, a modular fore-end hand guard/rail assembly apparatus for use with a firearm having a barrel nut comprises a bushing element disposable about an exterior surface of the barrel nut and a hand guard having a first end disposable about an exterior surface of the bushing element, wherein the bushing element is frictionally retained about the barrel nut by the hand guard. In one embodiment, the bushing element comprises a plurality of bushing element members that have arcuate interior surfaces which collectively define an inner diameter wherein the inner diameter defined by the plurality of bushing element members is at least partially greater than the diameter of the exterior surface of the barrel nut and is in thermal and mechanical contact therewith. In another embodiment, the hand guard has an interior surface at a first end thereof which collectively defines an inner diameter which receives the exterior surface of the bushing element wherein the inner diameter of hand guard is greater than the diameter of the exterior surface of the bushing element and is in thermal and mechanical contact therewith.

According to a second aspect of the invention, a hand guard assembly kit for use with a firearm having a barrel nut, the kit comprises: a first bushing element disposable about an exterior surface portion of the barrel nut, the first bushing element comprising a material associated with a first thermal conductivity value; a second bushing element disposable about an exterior surface portion of the barrel nut, the second bushing element comprising a material associated with a second thermal conductivity value different from the first thermal conductivity value associated with the first bushing element; and a hand guard having a first end shaped to receive one of the first and second bushing elements therein.

According to a third aspect of the invention, an article of manufacture for use with a firearm hand guard and a firearm having a barrel nut, the article of manufacture comprises: a bushing element having a body member defining an interior diameter which is greater than a diameter of an exterior surface portion of the barrel nut and further defining an exterior surface shaped for receipt within an end of the hand guard.

According to fourth aspect of the invention, a method for controlling the rate of heat transfer between hand guard assembly and the barrel nut of a firearm comprises: A) exposing the barrel nut of the firearm; B) disposing a bushing element about an exterior portion of the barrel nut so that the bushing element is thermally coupled to the barrel nut, the bushing element having an associated thermal conductivity value which is different from a thermal conductivity value associated with the barrel nut; and C) disposing the hand guard about an exterior portion of the bushing element so that the hand guard is thermally coupled to the bushing element.

For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
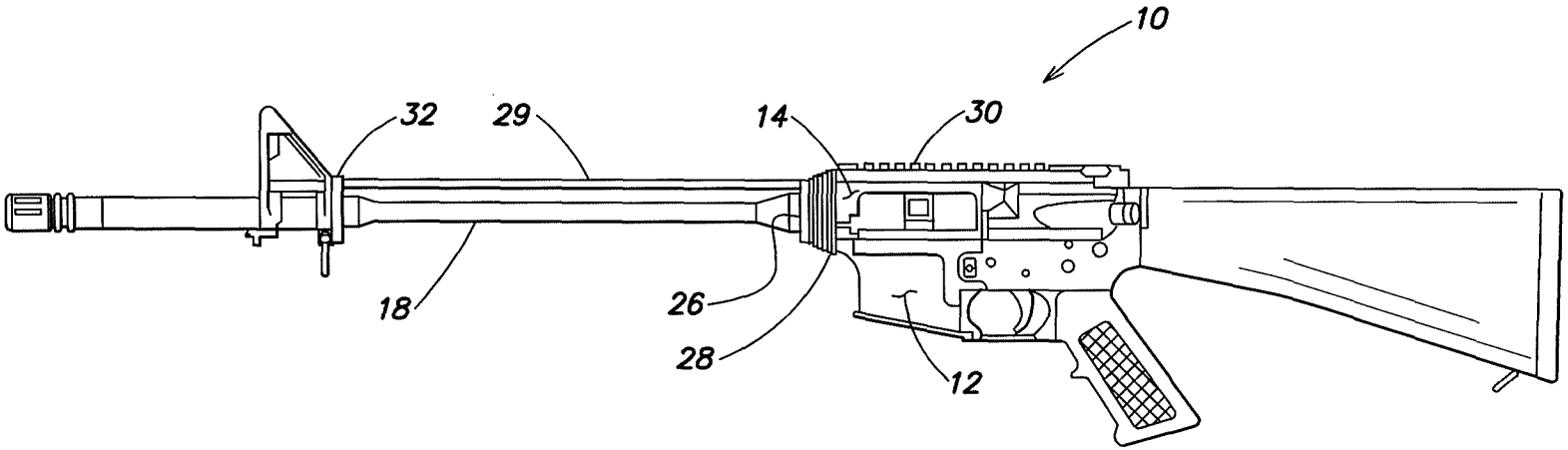
FIG. 1 (Prior Art)
FIG. 1 is a side view of a prior art conventional M16/M4 firearm with the standard hand guards removed to show the barrel, barrel nut and delta ring.

Referring to FIG. 1, a conventional M16/M4 weapon system is shown and generally illustrated at 10, comprising an upper receiver 14 and a lower receiver 12. The barrel 18 is attached to the front of the upper receiver 14 by inserting the rear end of the barrel 18 into a barrel-receiving receptacle (not shown) at the front end of the upper receiver 14. The barrel 18 is held in assembled relation with the upper receiver 14 by a barrel nut 26 that is threaded onto the outside surface of the barrel-receiving receptacle. In this manner, the barrel nut 26, having sprocket edged flange 27, is rigidly engaged with the barrel receiving receptacle and the upper receiver 14 of the weapon 10, while also serving to retain the barrel 18 in its installed position. A "delta ring" 28, as seen in FIG. 1, encircles the barrel nut 26 and provides a spring loaded ring for attachment and support of the M16/M4 standard hand guards between the delta ring 28 and a forward receptor cap (not shown) mounted at the front end of the barrel 18. A gas tube 29 extends from the upper receiver 14 to the receptor cap at the front end of the barrel 18. The M16/M4 weapon system 10 may also include a dovetail rail interface 30 integrally formed along the top of the upper receiver 14.

Figure 2:
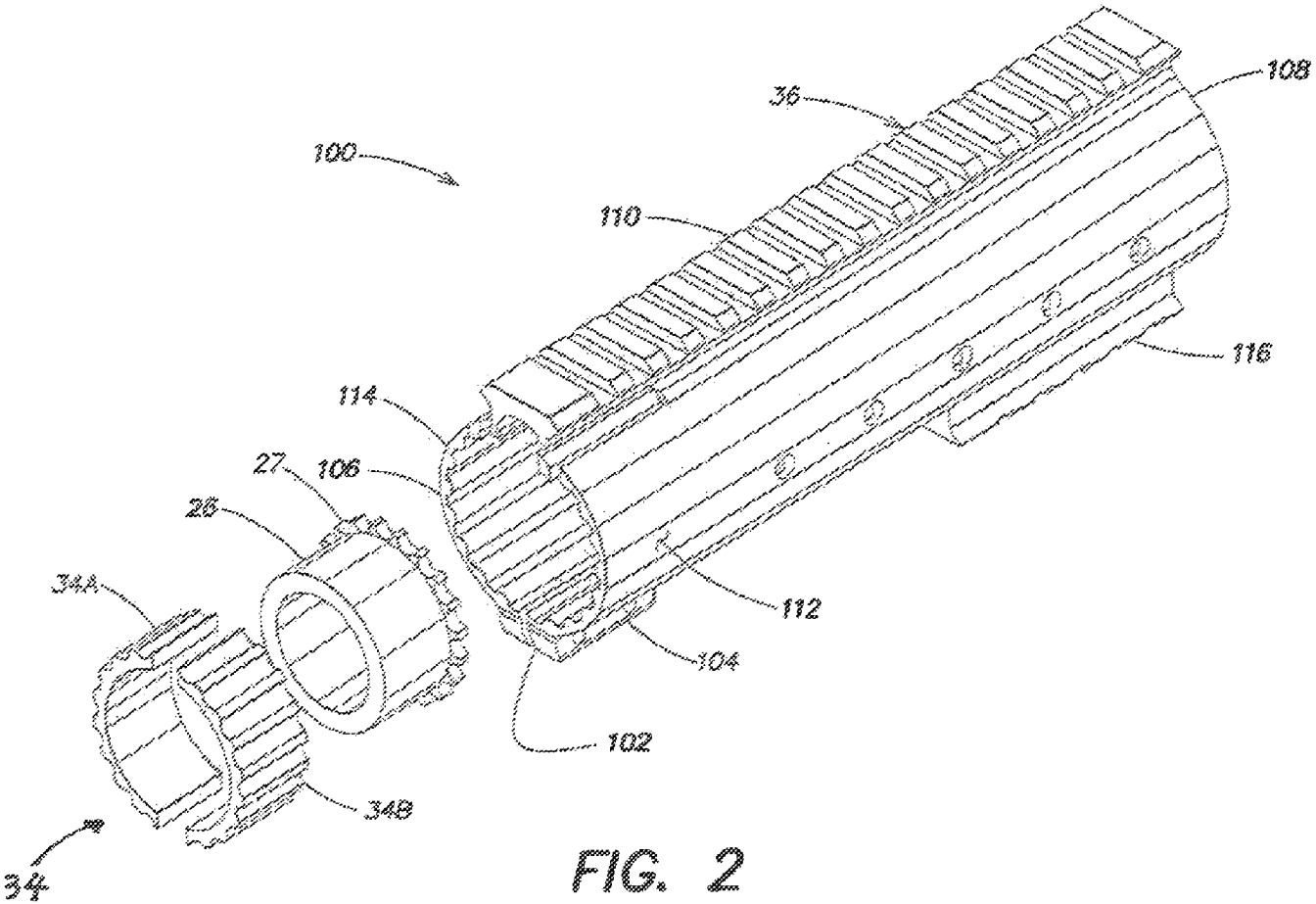
FIG. 2 is an exploded perspective view of an embodiment of the modular fore-end rail assembly in accordance with the disclosure.
Figure 3:
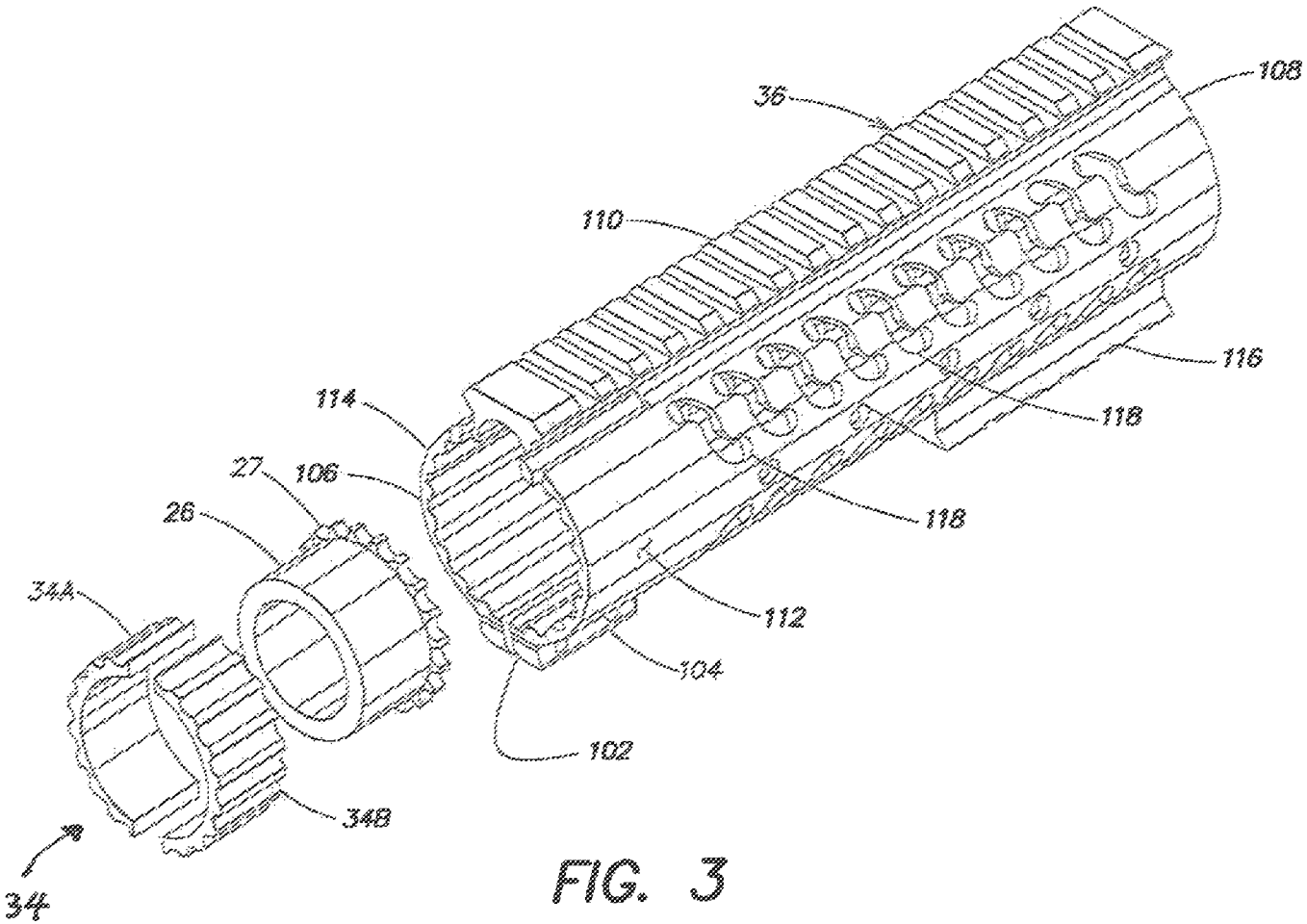
FIG. 3 is an exploded perspective view of an alternative embodiment of the modular fore-end hand guard/rail assembly in accordance with the disclosure.

FIGS. 2-3 illustrate embodiments of the modular fore-end hand guard/rail assembly 100 in accordance with the disclosure. The modular fore-end rail assembly 100 comprises a hand guard 36 and bushing 34. Hand guard 36 is the structural element that supports the entire fore-end rail assembly and serves to transfer the loads or additional weight induced by any attachments into the upper receiver 14 of the firearm 10. Bushing 34 is both thermally and mechanically coupled intermediate barrel nut 26 and hand guard 36 to selectively control the transfer of heat therebetween, as described herein in greater detail.

Hand guard 36 may be formed generally as a tubular enclosure that is configured to encircle the barrel 18 of the firearm 10 when assembly 100 is installed on the firearm 10 in a mounted position. In the illustrative embodiments, hand guard 36 has a unitary or monolithic construction defined by left and right side walls 112 and 114 that extend between ends 106 and 108 and generally outwardly and downwardly in an arcuate manner from an integrally formed top dovetail rail 110 to form a substantially cylindrical body. Top dovetail rail 110 extends at least partially longitudinally between the forward end 106 and the rearward end 108. An optional bottom dovetail rail interface 116 may be slidably attached to the bottom of hand guard 36 utilizing an integrally formed projection having a complementary mating cross-sectional profile receivable within the interface 116. Bottom dovetail rail interface 116 may be located anywhere along the bottom exterior surface of hand guard 36.

Although supplemental rail 116 is illustrated as being connected at the bottom of the guard 36, it is contemplated herein that similar such supplemental rail may likewise be configured for placement longitudinally along either the left or right sides of hand guard 36, typically in parallel with the axis of barrel 18 and rail 110, the exact length and placement of the rail relative to ends 106 and 108 of hand guard 36 being left to the designer's discretion.

End 106 of hand guard 36 contains a slot 102 partially separating side walls 112 and 114. One half of clamping assembly 104 is formed integrally on the exterior surface of hand guard 36 adjacent each side of slot 102. Each clamping assembly half has one or more apertures for receiving screws or other mechanisms to secure sidewalls 112 and 114 together once hand guard 36 has been secured about bushing 34.

Side walls 112 and 114 have an interior surface at first end 106 which collectively defines an inner diameter which, in the illustrative embodiment, receives the exterior surface of the bushing element 34. The diameter of the interior surface defined by the hand guard 36 is greater than a diameter of the exterior surface of the bushing element 34 and is in thermal and mechanical contact with the exterior surface of the bushing element 34 when disposed thereabout. In the illustrative embodiment, hand guard 36 may comprise any substantially rigid material such as hardened anodized aluminum, steel, composite materials, etc.

Figure 7:
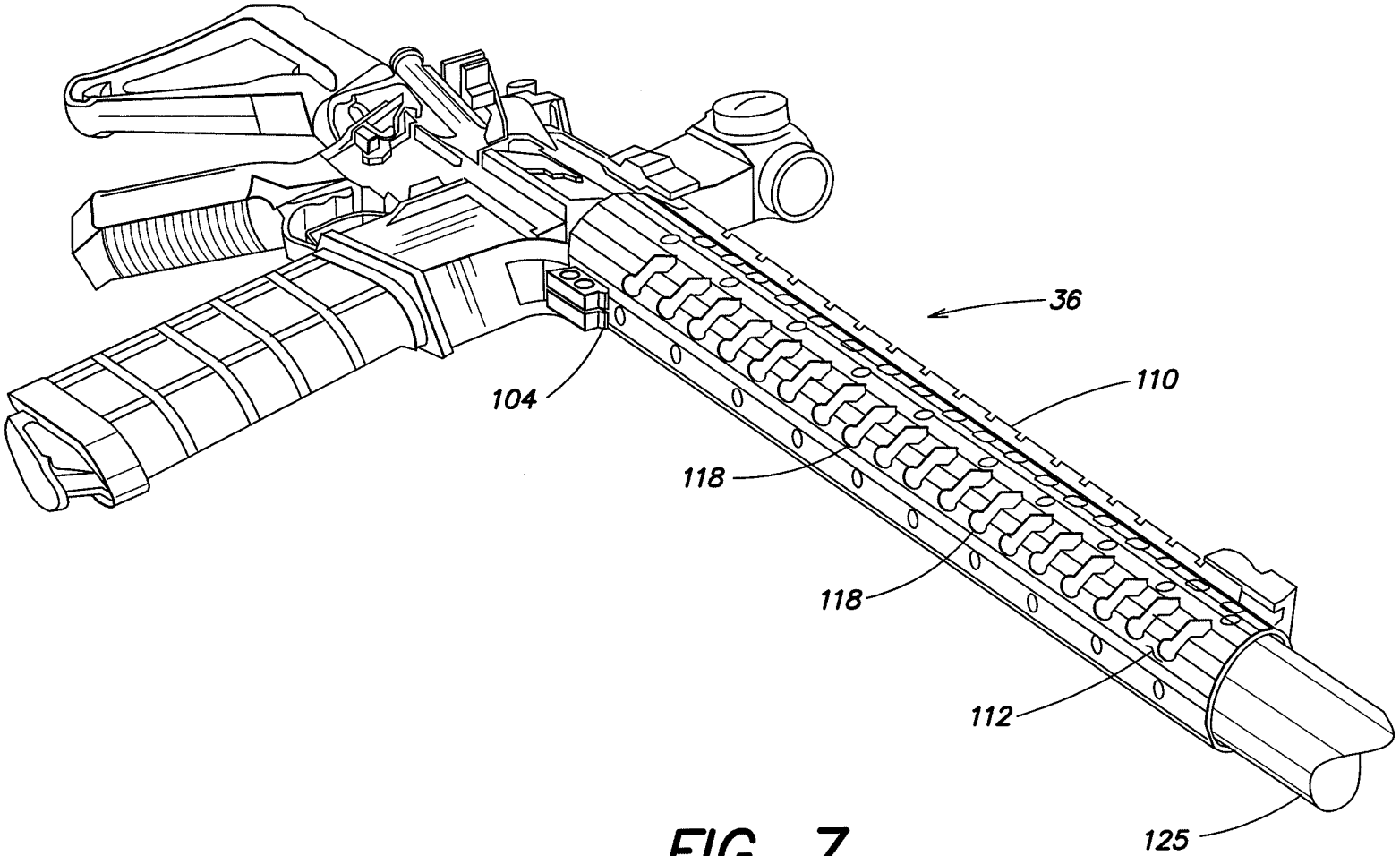
FIG. 7 is a perspective view of another alternative embodiment of the modular fore-end hand guard/rail assembly having in accordance with the disclosure.

In the embodiment of assembly 100, as illustrated in FIG. 2, side walls 112 and 114 of the hand guard 36 may have a plurality of wall vents 118 extending therethrough to facilitate cooling of barrel 18 by allowing heated air from the interior of hand guard 36 to escape through the vents. In embodiment illustrated in FIG. 3, side additional wall vents 118 having an "S" shape further facilitate cooling of the barrel 18. It will be obvious to those reasonably skilled in the art that any configuration or shape of sidewall vents, including an open lattice structure, may partially define one or both of sidewalls 112 and 114. FIG. 7 is a perspective view of another alternative embodiment of the modular fore-end hand guard/rail assembly 100 as installed on a firearm. As illustrated, hand guard 36 has a plurality of circular and S-shaped wall vents 118 extending therethrough to facilitate temperature exchange between the interior and the exterior of the hand guard 36. It will be further obvious to those reasonably skilled in the art that hand guard 36 may have other cross-sectional profiles, such as a pentagon or octagon or other configuration.

In addition, although hand guard 36 in the illustrative embodiment forms and integral sleeve-like structure, it is contemplated herein that one or more constituent components thereof, may be separately assembled into a sleeve-like structure which is insertable over the open end of barrel 18.

Bushing 34 comprises a pair of arcuate members 34A-B which, in the embodiments illustrated in FIG. 2-3, collectively form a smooth interior diameter which rests adjacent the smooth exterior portion of barrel nut 26 adjacent the sprocket-edged flange 27 of the barrel nut. The exterior surfaces of bushing members 34A-B mimic number and shape of the sprocket features of barrel nut 18 so that when disposed thereabout the bushing members 34A-B and sprocket-edged flange 27 form a continuous surface having uniform shape and diameter which is then received in open end 106 of hand guard 36. As illustrated, a portion of the interior surface of hand guard 36 formed by sidewalls 112 and 114 proximate end 106 has the same shape as the exterior surface formed by the combination of bushing 34 and flange 27, to allow the bushing element 34 to be frictionally retained about barrel nut 26 by the hand guard 36.

The plurality of bushing members 34A-B may comprise a metal such as stainless steel, a natural or synthetic resin, ceramic, a hybrid composite material or any other suitable materials with properties chosen to increase or decrease the rate at which heat is transferred from the barrel nut 26 to the hand guard 36. Table 1 below lists the thermal conductivity values for a plurality of materials suitable to implement bushing 34 with reference to the thermal conductivity of air.

TABLE 1

| Material | Thermal conductivity (cal/sec)/(cm$^2$ C./cm) | Thermal conductivity (W/m K)* |
|---|---|---|
| Silver | 1.01 | 406.0 |
| Copper | 0.99 | 385.0 |
| Gold | . . . | 314 |
| Brass | . . . | 109.0 |
| Aluminum | 0.50 | 205.0 |
| Iron | 0.163 | 79.5 |
| Steel | . . . | 50.2 |
| Lead | 0.083 | 34.7 |
| Glass | 0.0025 | 0.8 |
| Stainless Steel | . . . | 16.2 |
| Air at 0° C. | 0.000057 | 0.024 |

To decrease the rate at which heat is transferred from the barrel nut to the hand guard, the material which comprises the bushing element should have a lower thermal conductivity value associated therewith than the material from which the barrel nut is manufactured. Conversely, to accelerate the rate at which heat is transferred from the barrel nut to the hand guard requires a bushing element comprising material having a higher thermal conductivity value associated therewith than the material from which the barrel nut is manufactured. The environment and situation with which a firearm is used will effect the rate at which the barrel temperature increases, e.g. typically related to the number of shots fired within a period of time. Accordingly, the thermal conductivity requirement of bushing element 34 necessary to maintain hand guard 36 at a safe temperature will be different for a firearm used in target practice or hunting versus one used in actual combat situation. It is contemplated within the present disclosure that hand guard 36 may be sold in conjunction with one or more bushing elements 34, where each bushing element may have different thermal conductivity value associated therewith, or that kits of multiple bushing elements having different thermal conductivity values may be sold. For example, a first bushing element may be made of aluminum while second bushing element may be made of brass or steel. It is further, contemplated that the respective bushing element components 34A-B multiple bushings 34 may be interchangeable so that, for example, a bushing element component 34A made of aluminum may be matched and used with bushing element components 34B made of steel. Such combination maybe useful where different heating or cooling of a particular portion of hand guard 36, for instance the top or bottom or one side, is desired. The hand guard 36, when installed, encircles and protects both the barrel 18 and gas tube 29.

Figure 4:
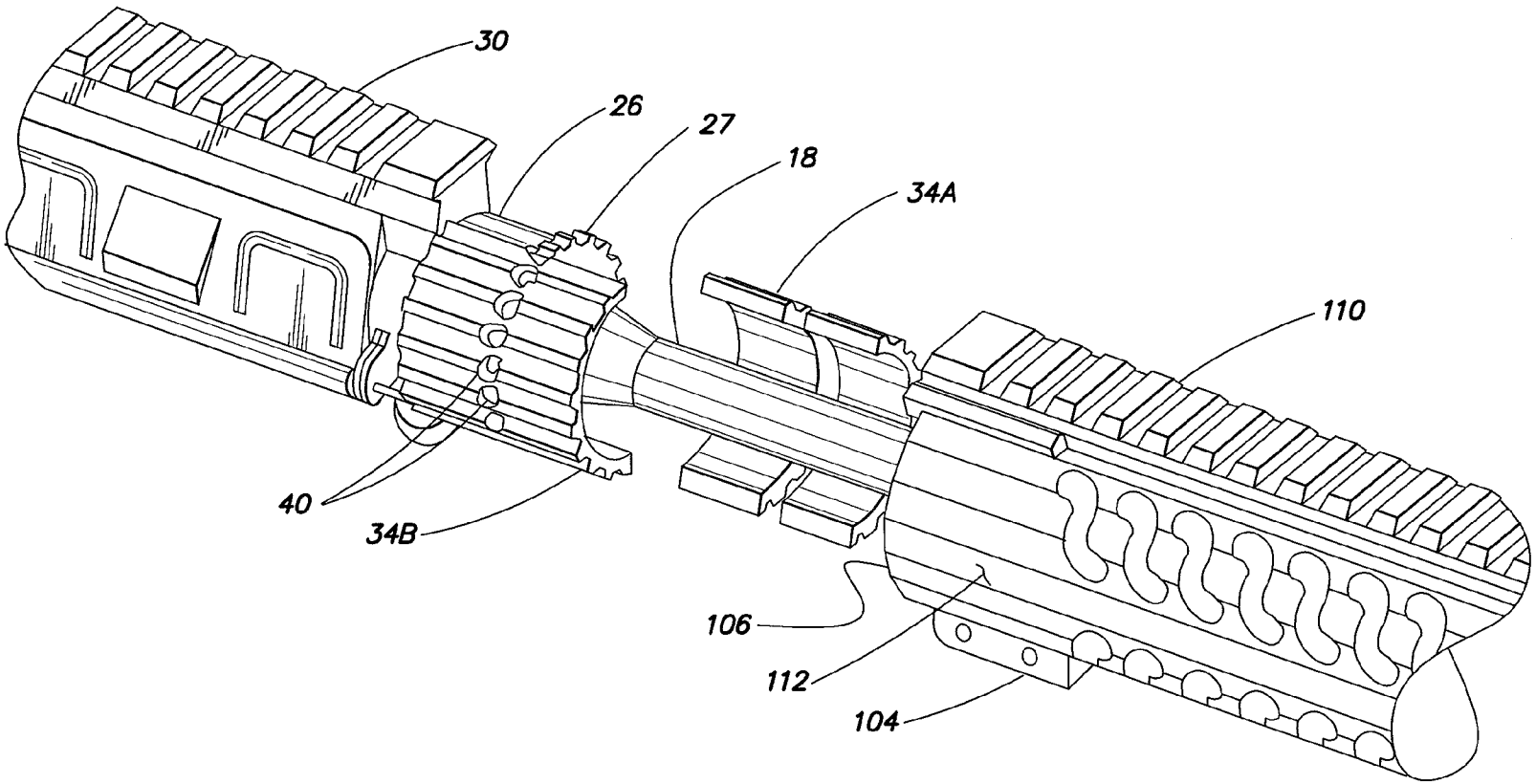
FIG. 4 is an exploded perspective view of an alternative embodiment of the bushing element in accordance with the disclosure.
Figure 5:
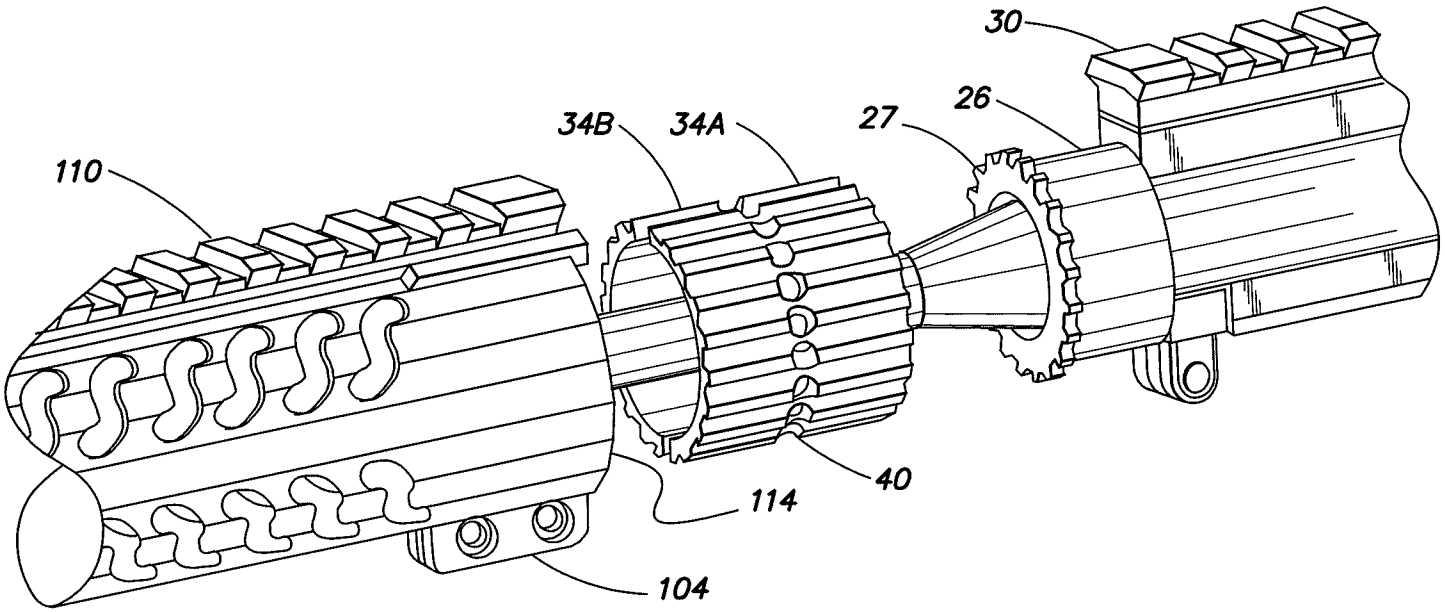
FIG. 5 is a perspective view of the embodiment of FIG. 4.
Figure 6:
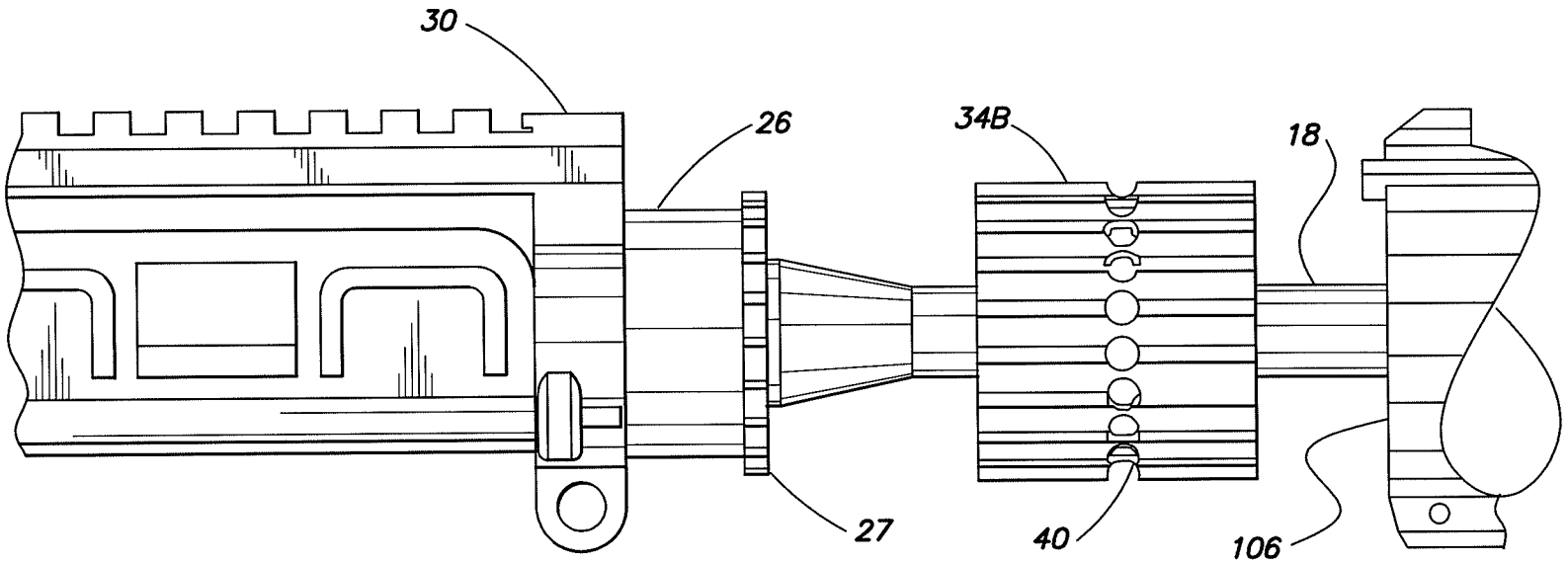
FIG. 6 is a side view of the embodiment of FIG. 4.

FIGS. 4-6 illustrates an alternative embodiment of bushing element 34 in which one or both of elements 34A-B extend both forward and aft of the sprocket-edged flange 27 of barrel nut 26. A plurality of holes 40 are disposed in a linear, arcuate manner substantially at the midline of each bushing element 34A-B and releasably engage sprocket-edged flange 27 of the barrel nut 26. This configuration further aids in the rapid installation and swapping of bushing elements 34 and, therefore, rapid and selective changes in the heating rate of the hand guard 36. In addition, the embodiment of FIG. 4 approximately doubles the thermally conductive exterior surface area of bushing 34 in contact with hand guard 36 to facilitate thermal exchange therebetween.

As illustrated in FIGS. 4-6, barrel nut 26 is disposed about an outer surface of a barrel 18. A bushing elements 34A-B are disposed about an exterior surface of the barrel nut 26. The hand guard 36 has a first end 106 disposed about an exterior surface of the bushing element 34, wherein the bushing element 34 is frictionally retained about the barrel nut 26 within the end 106 of hand guard 36.

In the embodiment shown in FIG. 6, the bushing element 34 comprises a plurality of bushing element members 34A-B, each having arcuate interior surfaces which collectively define an inner diameter greater than a first diameter of the exterior surface of the barrel nut 26 and in thermal and mechanical contact therewith. Bushing element members 34A-B, each have exterior surfaces which collectively define an exterior diameter substantially similar to the exterior diameter of flange 27 of barrel nut 26 but less than the inner diameter of hand guard 36 proximate end 106.

FIG. 7 is a perspective view of an embodiment of the modular fore-end hand guard/rail assembly in which the inner diameter proximate end 108 of hand guard 36 is sized to allow for other firearm accessories, such as any number of commercially available sound suppression devices 125, as illustrated, to be secured about the open and of the firearm barrel. Accordingly, the disclosed hand guard not only provides ample space for air exchange between the barrel of the firearm and the hand guard 36 but will not prevent the attachment of other accessories, such as a sound suppression device, about the firearm barrel.

It can be therefore seen that the disclosure provides a new and improved modular fore-end hand guard/rail assembly for mounting onto a firearm without requiring modification of the standard barrel nut. It can be further seen that the disclosure provides a modular fore-end rail system that includes a bushing element disposed between the barrel nut and the rail assembly, which may be easily changed to modify the thermal transfer characteristics between the barrel nut and the hand guard/rail assembly.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A hand guard system configured for use with a firearm having a barrel nut, the system comprising:

a bushing element disposable about an exterior surface portion of the barrel nut, the bushing element having a sprocketed exterior surface; and a hand guard having a first end shaped to receive the bushing element therein;

wherein the bushing element is frictionally retained intermediate the barrel nut and the hand guard and in thermal contact with the barrel nut and the hand guard.

2. The system of claim 1 wherein the bushing element comprises a plurality of members.

3. The system of claim 2 wherein the plurality of bushing element members have arcuate interior surfaces which collectively define an inner diameter.

4. The system of claim 3 wherein the inner diameter defined by the plurality of bushing element members is greater than a diameter of the exterior surface portion of the barrel nut.

5. The system of claim 2 wherein the bushing element comprises a series of apertures for accommodating features of the barrel nut.

6. The system of claim 1 wherein the hand guard comprises a plurality of members.

7. The system of claim 1 wherein the hand guard has interior surfaces at the first end thereof which collectively define an inner diameter shaped to receive an exterior surface of the bushing element.

8. The system of claim 7 wherein the inner diameter defined by the hand guard is greater than a diameter of the exterior surface of the bushing element and is in mechanical contact therewith.

9. The system of claim 1 wherein a second end of the hand guard has an inner diameter sized to accommodate a sound suppression accessory disposed intermediate the firearm and the hand guard.

10. A hand guard system configured for use with a firearm having a barrel nut including a flange having a first engagement feature, the system comprising:

a bushing element disposable about an exterior surface portion of the barrel nut, the bushing element including an exterior surface having a second engagement feature, the second engagement feature being sprocketed and matching the first engagement feature; and a hand guard having a first end shaped to receive the bushing element therein;

wherein the bushing element is frictionally retained intermediate the barrel nut and the hand guard and in thermal contact with the barrel nut and the hand guard.

11. A hand guard system configured for use with a firearm having a barrel nut including a flange having a first engagement feature, the system comprising:

a bushing element disposable about an exterior surface portion of the barrel nut, the bushing element including an exterior surface having a second engagement feature, the second engagement feature being sprocketed and matching the first engagement feature; and a hand guard having a first end shaped to receive the bushing element therein, the hand guard including an interior surface having a third engagement feature, the third engagement feature complementarily mating the first and second engagement features;

wherein the bushing element is frictionally retained intermediate the barrel nut and the hand guard and in thermal contact with the barrel nut and the hand guard.

* * * * *